United States Patent [19]

Harlow

[11] Patent Number: 4,768,276

[45] Date of Patent: Sep. 6, 1988

[54] METHOD OF APPLYING A FASTENER TO SHEET MATERIAL

[75] Inventor: Richard L. Harlow, Lexington, Ky.

[73] Assignee: Universal Fasteners Inc., Lawrenceburg, Ky.

[21] Appl. No.: 59,810

[22] Filed: Jun. 9, 1987

Related U.S. Application Data

[63] Continuation-in-part of Ser. No. 845,520, Mar. 28, 1986, abandoned.

[51] Int. Cl.[4] ..... B23P 11/00

[52] U.S. Cl. ..... 29/432; 29/446; 29/450; 29/525.1; 227/15

[58] Field of Search ..... 29/432, 446, 526 R, 29/450, 432.1, 432.2; 24/90 C, 93, 90 E, 103, 94, 95, 96, 101, 103; 227/15, 12, 64–66, 16–18, 140, 143

[56] References Cited

U.S. PATENT DOCUMENTS

| | | | |
|---|---|---|---|
| 691,937 | 1/1902 | Freschl | 227/15 X |
| 1,838,973 | 12/1931 | Wilder | 227/15 |
| 2,071,507 | 2/1937 | Dews | 29/432.1 |
| 2,310,007 | 2/1943 | Wolff | 29/432.1 |
| 2,451,487 | 10/1948 | Huelster | 24/94 |
| 2,997,715 | 8/1961 | Chapman | 227/140 X |
| 3,608,179 | 9/1971 | Jeffree et al. | 29/446 |
| 3,967,348 | 7/1976 | Rojen | 24/90 C X |
| 4,309,806 | 1/1982 | Cilione | 29/432.1 |
| 4,454,650 | 6/1984 | Silver | 227/15 X |
| 4,579,270 | 4/1986 | Matsuda | 227/15 X |

*Primary Examiner*—Charlie T. Moon

*Attorney, Agent, or Firm*—Hill, Van Santen, Steadman & Simpson

[57] ABSTRACT

An apparatus for joining two elements of a fastener element together with a sheet of compliant material sandwiched therebetween includes an apertured member whose opening is shaped to accept one of the fastener elements. The remote end of the fastener element has a recess therein with the material stretched taut across the opening to the recess. A prong member pierces the material and seats itself in the recess with the material immediately surrounding the recess lying in a wrinkle free condition.

5 Claims, 2 Drawing Sheets

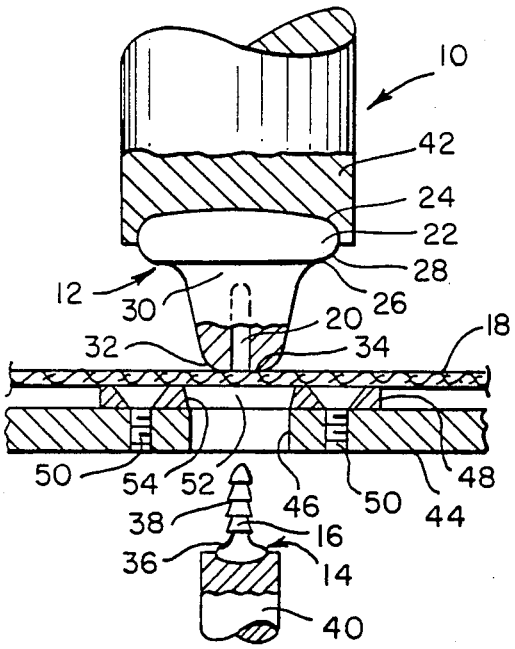
FIG. 1
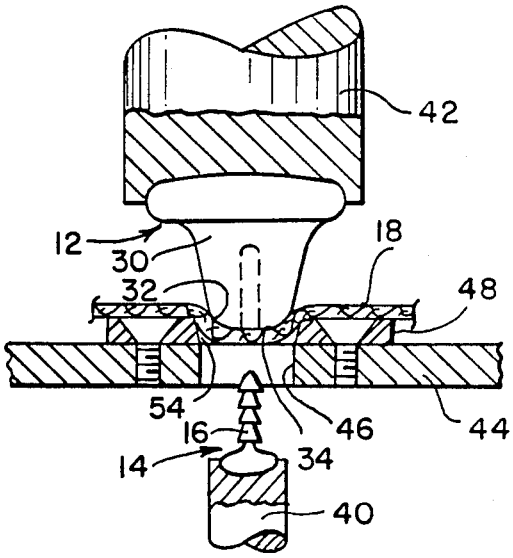
FIG. 2
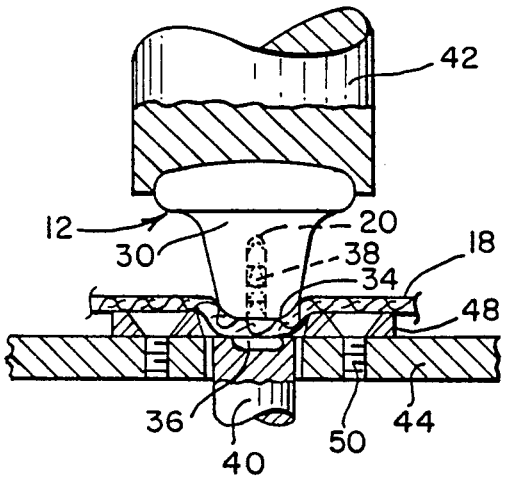
FIG. 3
FIG. 5
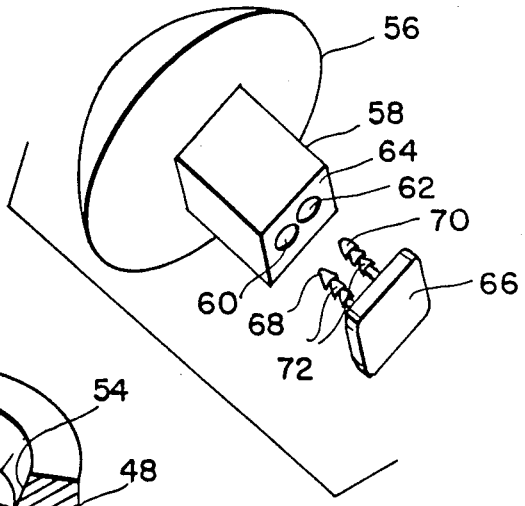
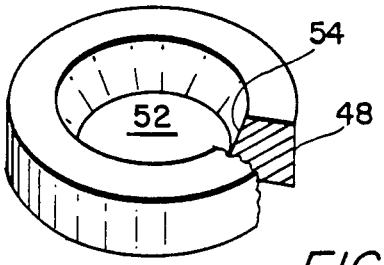
FIG. 4

METHOD OF APPLYING A FASTENER TO SHEET MATERIAL

CROSS-REFERENCE TO RELATED APPLICATION

This patent application is a continuation-in-part of my copending U.S. patent application Ser. No. 845,520 filed Mar. 28, 1986, now abandoned, and which is incorporated herein by reference.

BACKGROUND OF INVENTION

1. Field of the Invention

The invention relates to methods and apparatus for attaching two components of a fastener to a garment or to a compliant sheet of material in sandwich configuration without puckering or wrinkling the material.

2. Description of the Prior Art

The prior art, as exemplified by U.S. Pat. Nos. 2,071,507, 2,310,007, 4,309,806, and 4,454,650 contains a number of methods and apparatus for applying a fastener member to sheet material that is maintained in a relatively taut or tensioned condition as the prongs pierce the material and are received in the fastener member. In Dews, U.S. Pat. No. 2,071,507, a snap fastener is applied to an elastic sheet material in which the sheet material is stretched over an eyelet member, perforated at the tip after which the elastic material snaps down the post towards the base of the eyelet. A stud is clamped thereon and the sheet material, because it has been stretched and perforated snaps to a smooth plane. U.S. Pat. No. 2,310,007 has a plurality of clamps that attempt to maintain the material in position, but the material tends to give when the prongs penetrate therethrough, resulting in some puckering or wrinkling around the fastener element. As shown and described in U.S. Pat. No. 4,309,806, a flexible circular member affixed to the socket member engages the material and tends to urge the sheet material circumscribed thereby into a stretched position as the prong members penetrate the material. Silver, U.S. Pat. No. 4,454,650 drives the upper component of the fastener through an opening in the table that is substantially larger than either the upper or lower component and unto a stationary lower component immediately beneath the fabric, which fabric is not held so as to be stretched taut over the opening. However, the prior art methods and apparatus are limited to frictionally holding a sheet of material in a given plane as shown in U.S. Pat. Nos. 2,310,007 and 4,309,806; or require deformation of an elastic sheet material that snaps into position once it is perforated as shown in U.S. Pat. No. 2,071,507; or drive the upper component and material onto a stationary lower component without the material being held in place as shown in U.S. Pat. No. 4,454,650.

As described hereinafter, the subject invention avoids wrinkling of the sheet material after the application of a fastener member thereto.

SUMMARY OF THE INVENTION

The invention is summarized as a method and apparatus for applying a fastener having a body member and a rivet member to compliant sheet material including an apertured member, having an opening therein coaxially aligned with first and second tool members, the inner peripheral wall of the apertured member being of substantially the same cross-sectional configuration as the body of the fastener, the opening of the apertured member being of a size large enough to accept the body of the fastener with the upper portion of the inner peripheral wall of the opening adapted to cooperate with the outer peripheral surface of the body of the fastener to capture the material therebetween and stretch the material taut over the bottom end of the body of the fastener such that a post member can pierce the material and be received within a recess in the bottom end of the body without wrinkling or puckering the material.

An object of the invention is an improved method and apparatus for applying a fastener element to a compliant sheet of material without wrinkling.

Another object of the invention is to confine the drawing or stretching of the sheet material during the setting operation to that part of the sheet material which is immediately adjacent the point at which the post pierces the material.

Other objects, advantages and features of the invention will be apparent from the following description of the preferred embodiments taken in conjunction with the accompanying drawings.

BRIEF DESCRIPTION OF THE DRAWINGS

FIG. 1 is a diagrammatical view, partly in section, of the apparatus for applying a button and rivet to a sheet of compliant material just prior to the assembly operation;

FIG. 2 is a view similar to FIG. 1 and showing the apparatus during the initial application of the button and rivet to the sheet of material;

FIG. 3 is a view similar to FIG. 2 and showing the apparatus during the final step of application of the button and rivet to the sheet of material;

FIG. 4 is a perspective view, with a portion shown in section, of the annular member that captures the sheet material during application of the button and rivet thereto;

FIG. 5 is a perspective view of another embodiment of the button and rivet of the invention;

DESCRIPTION OF THE PREFERRED EMBODIMENTS

Figure 6:
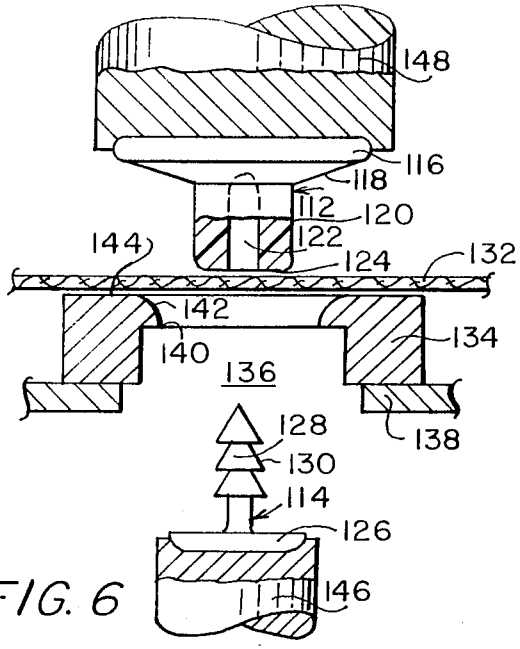
FIG. 6 is a view similar to FIG. 1 and showing another embodiment of the apparatus for applying a button and rivet to a thin sheet of compliant material just prior to the assembly operation.

As illustrated in FIGS. 1, 2, and 3 of the drawings, the apparatus for applying a button and rivet to a sheet of material as embodied in the present invention is illustrated and generally indicated at 10. Although only a portion of the apparatus for assembling the button and rivet is illustrated in the drawings, the general details of the structure and operation of the complete apparatus is well known in the art, and one embodiment of such apparatus is shown and described in the patent to Schmidt, et al U.S. Pat. No. 3,803,698.

In FIG. 1, there is shown a button fastener 12 and a rivet 14 that embody the present invention and include a pronged member 16 on rivet 14 to penetrate a compliant material 18, such as cloth, to seat member 16 in recess 20, to thereby join button 12 and rivet 14 together with material 18 located therebetween. Button 12 is formed of a malleable material, such as plastic, with the diameter of recess 20 being slightly smaller than the diameter of member 16.

Button 12, which has a head element 22 that can be of any particular shape, but is shown in the drawings as being circular, has an outer face 24, a planar inner face 26, joined by an arcuate edge 28. A base 30, tapering away from element 22, has an outer curved surface wall 32, with a base diameter smaller than the diameter of face 26 of button 12. Base 30 is centrally disposed thereon, and extends away from inner face 26 to a remote end 34 which has a diameter smaller than the base diameter. Remote end 34 of base 30, which has recess 20 centrally located therein, is in a plane substantially parallel to the plane of face 26.

Rivet 14 has a cap member 36, whose diameter is slightly larger than end 34, which is integrally formed with pronged member 16 and carries a plurality of barb-like members 38.

As is shown in FIGS. 1–3, the setting station includes an anvil 40 and a coaxially mounted ram 42, both resiliently mounted by coiled spring members, not shown. The uppermost end of anvil 40 is formed with a concave configuration for receiving cap member 36 of rivet 14 in seated relation as the rivet 14 is fed thereto by suitable means prior to the assembly operation. Similarly, the lowermost end of ram 42 is provided with a specific configuration for accommodating outer face 24 of button member 12 in engagement therewith, and ram 42 also cooperates with suitable feeding means that sequentially moves button members 12 to ram 42 at the assembly station. The anvil 40 and ram 42 are resiliently attached to drive means (not shown) arranged to drive in sequence first ram 42 and subsequently anvil 40 vertically toward each other.

In the drawings, there is shown a support table 44, containing an opening 46 therein and in coaxial alignment with anvil 40 and ram 42, each of which directs their respective rivet 14 and button 12 elements therethrough. An anti-pucker aperture member 48, having a raised annular shape as best shown in FIG. 4, encircles opening 46 and is attached to support table 44 by a plurality of bolts 50. Member 48 of FIGS. 1–4 has an inner opening 52 that is of substantially the same configuration as base 30 so that opening 52 can accommodate base 30 of button 12. The inner peripheral wall 54 of opening 52 is at an angle that is slightly larger (3 to 15 degrees) than the angle of the wall of tapered base 30. Compliant material 18 is positioned over opening 52 of device 48 at the precise point that button 12 and rivet 14 are to be attached.

The apparatus includes several drive means none of which have been shown in detail since a number of drive means can be used such as electric, electromechanical, hydraulic or pneumatic systems. Buttons 12 and rivets 14 are stored in hoppers (not shown) each hopper of which is provided with a drive means for moving the elements via a chute to a guide channel. A pusher member of each guide channel is operatively connected to drive means to push an element through its respective channel in a single step. Another drive means first drives the ram 42 and then the anvil 40 together to set the button 12 and rivet 14 on the material, with the last two drive means synchronized to provide the sequence of operation. Conventional means, such as a foot operated switch (not shown), are provided for the operator to actuate the drive means and effect the setting operation.

In order to operate the apparatus, buttons 12 and rivets 14 fill the appropriate hoppers and the system is charged by a sufficient number of actuations of the hopper drive means to fill the associated chutes with the fastener elements. Guides at the exit end of the chutes orient and position the buttons and rivets in the feed channel, where a pusher (not shown) moves the element to its proper position onto either ram 42 or anvil 40, as the case may be, and as shown in FIG. 1.

Apparatus 10 is now ready for the operator to position the material 18 in the setting area and actuate the apparatus drive means by an conventional means (not shown) such as the foot switch mentioned above. As ram 42 moves downward, remote end 34 of button 12 engages material 18 and carries that portion of the material 18 engaged into opening 52 of annular member 48 until the material is captured between the outer circular wall 32 of tapered base 30 of button 12 and the inner peripheral wall 54 of opening 52 of annular device 48. In so moving, compliant material 18 is stretched or pulled tight over the opening to recess 20 at remote end 34 of button 12. Because of different thicknesses to the material to be used, resiliently mounted ram 42 will move into opening 52 only that distance needed to capture material 18 between wall 54 and base 30 of button 12.

Next anvil 40 carrying rivet 14 moves upwardly whereby pronged member 16 pierces the taut material 18 covering the opening and enters recess 20. Further movement of resiliently mounted anvil 40 moves pronged member 16 into recess 20, where member 16 becomes fully seated. Barb-like members 38 prevent the withdrawal of member 16 of rivet 14 from recess 20 in buttor 12. Compliant material 18 is captured between remote end 34 of button 12 and cap member 36 of rivet 14. The anvil 40 and ram 42 are then drawn apart and the finished assembly removed.

The present fastener attaching apparatus has many features which represent significant advances in the art. Because material 18 is stretched taut over the remote end 34 of button 12 and the surrounding material is captured and held in place between curved wall 32 of base 30 and the inner peripheral wall 54 of opening 50 in annular member 48, pronged member 16 of rivet 14 readily pierces material 18 and enters recess 20. In so doing, none of material 18 surrounding recess 20 is dragged into recess 20 to cause a pucker in the material immediately surrounding the button attachment. This is particularly important because the material to which the button is attached has been cut to shape and perhaps matched to the article. A poorly installed button and rivet results in a loss to the manufacturer.

Further, the equipment on which this invention is to be incorporated may require only a slight or perhaps no adjustment from its present sequence of operations. If the equipment is normally adjusted so that the button with the material lying thereunder is located at its fartherest downward movement in the plane of the upper surface of the support table, than adding annular member 46 will raise the plane at which the remote end 34 if button 12 engages material 18, and move the material to a position within member 48 such that the material on remote end 34 still lies in the plane of the upper surface of table 44. However, material 18 is captured between peripheral wall 54 and curved surface wall 32 of base 30 and the operation will be as described above with corresponding results.

The apparatus has been found to be suitable for all types of material and can be used interchangeably therewith. In particular the apparatus and method described and shown with reference to FIGS. 1–4 can be readily used with such heavy duty material as denim and corduroy.

It should be noted that annular member 48 with its opening 52 is shown as an attachment to the support table 44 by bolts 50. However, it is possible and perhaps desireable that support table 44 be modified so that opening 52 is formed directly in the upper surface of support table 44, thus obviating the need for a separate attachment.

In the modification shown in FIG. 5, the button 56 has been changed to include a tapered base 58 that has a substantially square configuration in cross section with two spaced recesses 60, 62 located on remote end 64. Similarly, rivet 66 has two prong members 68, 70 which are adapted to enter the recesses 60 and 62 of button 56 and be retained therein by barbed like members 72 located thereon. An anti-pucker device used in this instance would also assume a cooperating square shape with the walls of its opening apered to accommodate the square tapered base 58 of this modification. Other cross sectional shapes to the tapered base of the button with corresponding changes to the anti-pucker member and the number of interfitting prong members provide a pucker free installation.

The most desirable construction of the apparatus is where inner wall 54 of the anti-pucker device 48 completely encircles the entire circumference of outer curved wall 32 of base 30 of button 12 when base 30 is inserted into opening 52. However, it has been found in practice that the shape of the cooperating curved surface wall 32 and inner wall 54 can be of any cross sectional shape so long as a substantial portion of material 18 is nested in and captured between curved wall 32 and inner wall 54. The amount of material captured between the two walls 32 and 54 depends somewhat on the material used e.g.: stretch fabric requires a nearly 360° engagement whereas denim requires substantially less.

Figure 7:
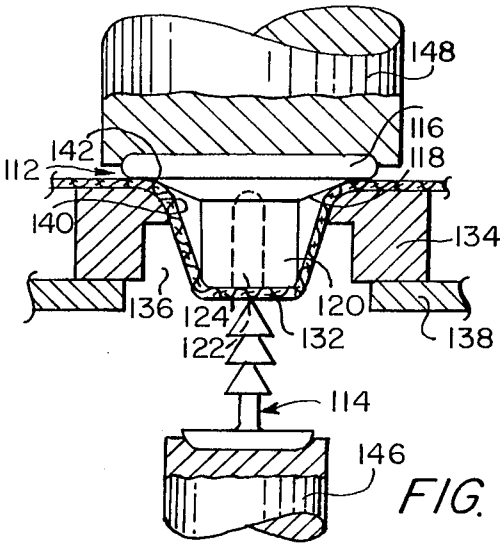
FIG. 7 is a view similar to FIG. 6 and showing the apparatus during the initial application of the button and rivet to the sheet of material.
Figure 8:
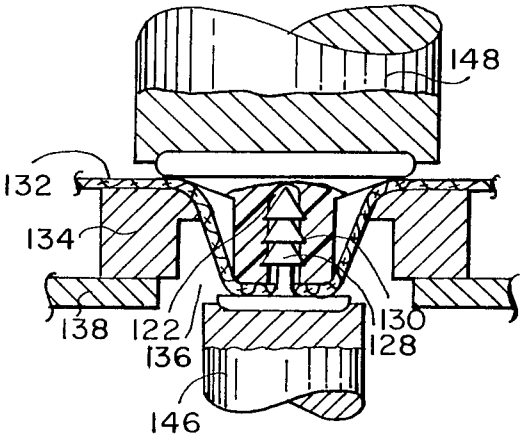
FIG. 8 is a view similar to FIG. 7 and showing the apparatus during the final step of application of the button and rivet to the sheet of material.

In the modification shown in FIGS. 6, 7 and 8, there is shown a button 112 and rivet 114 that are similar in configuration to button 12 and rivet 14 of FIG. 1. Button 112 includes a head element 116 having a lower surface 118, a base 120 and a recess 122 centrally located in remote end 124 of the button. Rivet 114 has a cap mber 126 and a pronged member 128 carrying a plurality of barb-like members 130. Compliant material 132 of this embodiment is very thin in cross section and manufactured from yarns generally made of synthetic materials which are closely spaced together. Because synthetic yarns have a low coefficient of friction, the material 132 is woven in a very compact weave and individual yarns in material 132 do not separate as readily as the yarns of material 18, whereby the yarns of material 132 will hang up on barb members 38 in the attaching operation if the apparatus of FIGS. 1–3 is used.

The anti-pucker aperture member 134 of FIGS. 6–8 encircles opening 136 and is secured to support table 138 by bolts or the like, not shown, in a manner similar to that as shown in FIGS. 1–3. Inner opening 136 is of the same configuration in cross section as base 120 of button 112; however, dimensionally opening 136 is substantially larger than base 120 but smaller than head element 116 of button 112. Inner peripheral wall 140 of opening 136 is rounded as at 142 to flare upwardly and outwardly with the uppermost portion of opening 136 merging with the flat upper surface 144 of member 134. Member 134 has a greater height than aperture member 48 of FIGS. 1–3 for reasons given below.

FIGS. 6–8 illustrate the setting station which includes a resiliently mounted anvil 146 and a coaxially resiliently mounted ram 148 attached to drive means (not shown) arranged to drive in sequence first ram 148 and thereafter anvil 146. Button 112 is received in a concave configuration on ram 148 and rivet 114 is located in a similar configuration on anvil 146. A foot operated switch (not shown) is used by the operator to actuate the mechanism to move ram 148 and anvil 146 toward each other in the proper sequence.

As shown in FIG. 6, material 132 is in the setting area and the operator can now actuate the drive means of the apparatus. Upon actuation, as shown in FIG. 7, ram 148 first moves downward, with the bottom end 124 of button 112 engaging material 132 and moving that portion of material under end 124 into opening 136 of member 134 until material 132 is captured between curved surface 142 of wall 140 and lower surface 118 of head element 116. Because of the increased height of member 13 base 120 of button 112 is driven farther into opening 136 and material 132 is drawn more taut across recess 122 of button 112.

In FIG. 8, anvil 146 is then moved upwardly in the sequence of operations whereby pronged member 128 of rivet 114 quickly and efficiently pierces material 132 and seats itself within recess 122 of button 112. Because material 132 is drawn more taut, the smaller yarns incorporated in this thin material are under greater tension and will be pierced and separated from adjacent yarns. Material 132 will not hang up on pronged member 128 so as to cover barb-like members 130 in a manner to prevent pronged member 128 from being permanently seated in reces 122 in which instance button 112 and rivet 114 could be pulled apart.

Figure 9:
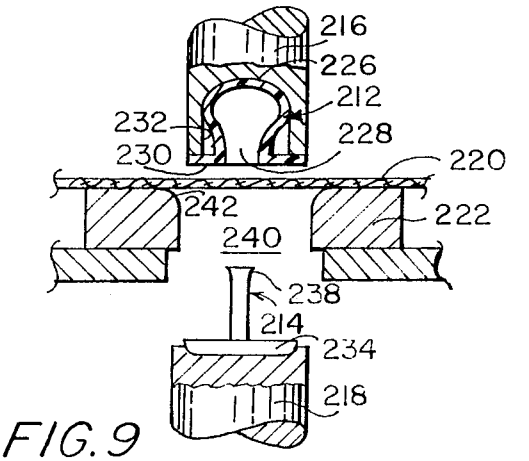
FIG. 9 is a view similar to FIG. 1 and showing still another embodiment of the apparatus for applying a post and stud of a snap fastener to a sheet of compliant material just prior to the assembly operation.
Figure 10:
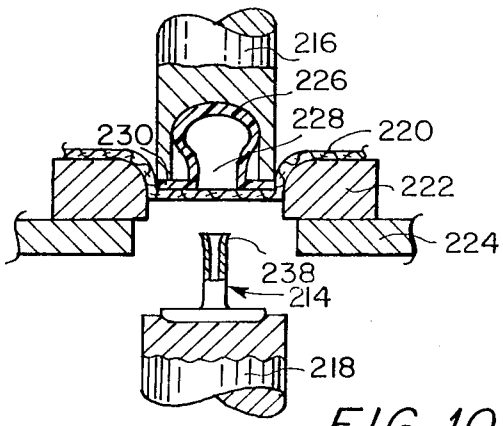
FIG. 10 is a view similar to FIG. 9 and showing the apparatus during the initial application of the post and stud to the sheet of material; and, FIG. 11 is a view similar to FIG. 10 showing the apparatus during the final step of application of the post and stud to the sheet of material.
Figure 11:
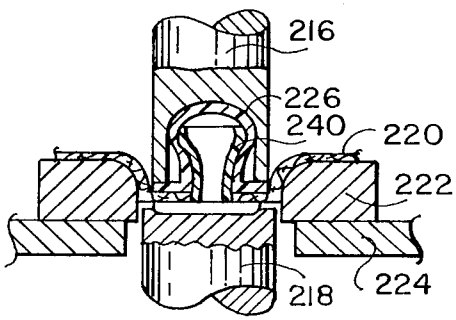

Still another embodiment of the invention is shown in FIGS. 9–11 wherein a snap fastener stud 212 and rivet 214 are mounted in resiliently mounted ram 216 and resiliently mounted anvil 218, respectively, with a sheet of compliant material 220 located intermediate thereof. An anti-pucker member 222 is secured to support table 224.

Stud 212 has a hollow domed shaped upper portion 226 having a central opening 228 with a flat radially extending flange like remote end 230 surrounding the opening. Stud 212 is adapted to be received in a recess 232 of ram 216, with end 230 resting upon and supported by the lower surface of ram 216. End 230 will engage material 220 and capture the same between its outer peripheral surface and the wall of recess 232.

Rivet 214 is carried by anvil 218 and includes a head member 234 and an upwardly extending hollow post 236 that has a slightly flared tip 238 that can be upset when driven into opening 228 of stud 212.

Aperture member 222 has a central opening 240 and a rounded edge 242 that will accept end 230 carrying a portion of material 220 before it.

In operation, as shown in FIGS. 9, and 10, the operator places material 220 over aperture member 222, trips the actuating mechanism and ram 216 carrying stud 212 descends. The bottom surface of end 230 engages material 220 and drives the material before it into opening 240 of member 222. Material 220 is captured between the peripheral walls of opening 240 and the outer periphery of end 230, whereby the material covering opening 228 is stretched taut.

Rivet 214 on anvil 218 is now moved upwardly with tip 238 piercing that portion of material 220 drawn taut and covering opening 228. Anvil 218 continues to drive rivet 214 upwardly until flared tip 238 engages the inner surface of domed member 226 at which time tip 238 is upset and assumes a bulbous shape 240 so as to be accommodated and seated within domed member 226. When ram 216 and anvil 218 are separated, material 220 can be removed from the apparatus with stud 212 and rivet 214 attached in a wrinkle-free installation.

In as much as the present invention is subject to many variations, modifications and changes in detail, it is intended that all matter contained in the foregoing description or shown on the accompanying drawings shall be interpreted as illustrative and not in a limiting sense.

What is claimed is:

1. A method of applying a fastener to compliant sheet material wherein said fastener includes a body member, having a remote end, a recess centrally disposed in the remote end of said body member, and a rivet member having a cap and a post extending therefrom adapted to pierce said material and be inserted into said recess of said body member for interlocking said body member and said rivet member on opposite sides of said sheet material, comprising the steps of:

positioning said sheet material over the opening of an apertured member, the inner peripheral wall of said opening shaped to accommodate and support said body member in said apertured member;

moving said body member to engage said remote end thereof with said material and displace same into said apertured member for drawing said material taut over said recess of said body member; and, driving said post of said rivet to pierce said material and penetrate said recess of said body member to interlock said rivet with said body member with said material located therebetween;

whereby said material surrounding said body member and rivet is wrinkle free.

2. A method as claimed in claim 1 comprising the further step of capturing said material intermediate said preipheral wall of said apertured member and the outer peripheral wall of said body member upon moving said body member into said apertured member whereby said material is stretched taut over said recess of said body member.

3. A method as claimed in claim 2 comprising the steps of providing a plurality of recesses in said remote end of said body member and a plurality of pronged members on said rivet;

orienting said body member and rivet; and, driving said body member and rivet together to interengage said aligned prongs and recesses to interconnect said body member and said rivet;

whereby said material surrounding said body member and rivet is wrinkle free.

4. A method as claimed in claim 2 in which said body member includes a button having a substantially vertically extending base and a head portion, includes the further step of:

seating said button within the opening of said apertured member whereby said material covering said recess in said base is maintained taut.

5. A method as claimed in claim 4 in which the apertured member has a curved upper surface, includes the step of:

engaging said material between the lower surface of the head of said button and the curved upper surface of the apertured member when said button is displaced substantially the maximum distance.

* * * * *